US012716137B2

(12) United States Patent
Joo et al.

(10) Patent No.: US 12,716,137 B2
(45) Date of Patent: Aug. 25, 2026

(54) CATALYST STRUCTURE FOR ELECTROCHEMICAL $CO_2$ REDUCTION, AND METHOD FOR PRODUCING SAME

(71) Applicant: SEOUL NATIONAL UNIVERSITY R&DB FOUNDATION, Seoul (KR)

(72) Inventors: Young Chang Joo, Seoul (KR); Jae Chan Lee, Seoul (KR)

(73) Assignee: SEOUL NATIONAL UNIVERSITY R&DB FOUNDATION, Seoul (KR)

( * ) Notice: Subject to any disclaimer, the term of this patent is extended or adjusted under 35 U.S.C. 154(b) by 972 days.

(21) Appl. No.: 17/768,299

(22) PCT Filed: Dec. 18, 2019

(86) PCT No.: PCT/KR2019/018039
§ 371 (c)(1),
(2) Date: Apr. 12, 2022

(87) PCT Pub. No.: WO2021/075638
PCT Pub. Date: Apr. 22, 2021

(65) Prior Publication Data

US 2023/0243051 A1 Aug. 3, 2023

(30) Foreign Application Priority Data

Oct. 15, 2019 (KR) ..... 10-2019-0127933

(51) Int. Cl.
*C25B 11/091* (2021.01)
*C25B 3/03* (2021.01)
(Continued)

(52) U.S. Cl.
CPC ..... *C25B 11/091* (2021.01); *C25B 3/03* (2021.01); *C25B 3/07* (2021.01); *C25B 3/26* (2021.01)

(58) Field of Classification Search
CPC .... C25B 1/23; C25B 3/03; C25B 3/07; C25B 3/26; C25B 11/02; C25B 11/054;
(Continued)

(56) References Cited

U.S. PATENT DOCUMENTS 10,046,971 B2 8/2018 Tohji
2012/0279870 A1* 11/2012 Assmann ..... C25B 1/00 205/351

(Continued)

FOREIGN PATENT DOCUMENTS

KR 20160034277 A 3/2016
KR 20160073331 A 6/2016

OTHER PUBLICATIONS

Ana Sofia Varela, Wen Ju, Alexander Bagger, Patricio Franco, Jan Rossmeisl, and Peter Strasser, Electrochemical Reduction of CO2 on Metal-Nitrogen-Doped Carbon Catalysts, ACS Catalysis 2019 9 (8), 7270-7284 (Year: 2019).*

(Continued)

*Primary Examiner* — Luan V Van
*Assistant Examiner* — Mofoluwaso S Jebutu
(74) *Attorney, Agent, or Firm* — Bridgeway IP Law Group, PLLC; Sang Ho Lee; Hyun Woo Shin

(57) ABSTRACT

A catalyst structure for electrochemical carbon dioxide ($CO_2$) reduction includes carbon nanofibers doped with nitrogen (N), and copper (Cu) particles dispersed on the carbon nanofibers. At least portions of the carbon nanofibers at interfaces with the Cu particles may have a pyridinic-N structure. The pyridinic-N structure is a first catalyst for reducing carbon dioxide ($CO_2$) to carbon monoxide (CO), and the Cu particles are a second catalyst for converting CO to a $C_2$ or higher hydrocarbon compound through dimerization between a plurality of CO molecules.

13 Claims, 10 Drawing Sheets

(51) Int. Cl.
*C25B 3/07* (2021.01)
*C25B 3/26* (2021.01)

(58) Field of Classification Search
CPC ... C25B 11/056; C25B 11/065; C25B 11/075; C25B 11/091
See application file for complete search history.

(56) References Cited

U.S. PATENT DOCUMENTS

2017/0283964 A1* 10/2017 Bulan ..... H01M 4/8896
2018/0200788 A1* 7/2018 Joo ..... B22F 1/16

OTHER PUBLICATIONS

Qing Li, Wenlei Zhu, Jiaju Fu, Hongyi Zhang, Gang Wu, Shouheng Sun, Controlled assembly of Cu nanoparticles on pyridinic-N rich graphene for electrochemical reduction of CO2 to ethylene, Nano Energy, vol. 24, 2016, pp. 1-9 (Year: 2016).*
Guangqiang Lv, Shiwei Chen, Hanfei Zhu, Ming Li, Yongxing Yang, Pyridinic-nitrogen-dominated nitrogen-doped graphene stabilized Cu for efficient selective oxidation of 5-hydroxymethfurfural, Applied Surface Science, vol. 458, 2018, pp. 24-31 (Year: 2018).*
Varela, et al. "Electrochemical Reduction of CO2 on Metal-Nitrogen-Doped Carbon Catalysts" ACS Catal, 2019, 9, 7270-7284.
Yuan, et al. "Tuning the activity of N-doped carbon for CO2 reduction via in situ encapsulation of nickel nanoparticles into nano-hybrid carbon substrates" J. Mater. Chem. A, 2019, 7,6894.
Pan, et al., "Efficient CO2 Electroreduction by Highly Dense and Active Pyridinic Nitrogen on Holey Carbon Layers with Fluorine Engineering" ACS Catal. 2019, 9, 2124-2133.

* cited by examiner (a)

(b)

(c)

(a)

(b)

CATALYST STRUCTURE FOR ELECTROCHEMICAL $CO_2$ REDUCTION, AND METHOD FOR PRODUCING SAME

TECHNICAL FIELD

The present invention relates to a catalyst structure for electrochemical carbon dioxide ($CO_2$) reduction, and a method of producing the same, and more particularly, to a catalyst structure for electrochemical $CO_2$ reduction, the catalyst structure having a carbon nanofiber composite structure in which carbon nanofibers are provided as a matrix and metal particles are dispersed on the matrix, and a method of producing the same.

BACKGROUND ART

The emission of carbon dioxide ($CO_2$) serving as a greenhouse gas has rapidly increased after the Industrial Revolution due to fossil fuel-based energy production.

Global warming caused by $CO_2$ emissions is rapidly changing the ecological environment of the earth, and countermeasures against global warming are being taken all over the worldwide as an issue of human survival. As a part of the countermeasures, research is being actively conducted on a method for removing and recycling $CO_2$. Low-temperature electrochemical $CO_2$ reduction technology may produce various types of high value-added chemical materials such as carbon monoxide (CO), formate, methane, ethylene, and alcohol depending on electrochemical catalysts. Metal catalysts such as indium (In) and cadmium (Cd) are known as highly selective and highly efficient catalysts for reduction to formate, some noble metals such as gold (Au) and silver (Ag) for reduction to CO, and copper (Cu) for conversion to a hydrocarbon compound. In particular, conversion to a $C_2$ or higher carbon compound such as ethylene is highly desirable from an economic point of view. For example, ethylene is a compound used as a raw material for various chemical processes to synthesize polyethylene, ethylene glycol, etc., and has a very high economic prospect due to its market size of about 1.8 trillion dollars per year based on annual production and price. To convert $CO_2$ to a $C_2$ or higher hydrocarbon compound, a catalyst system capable of increasing carbon-carbon bonding ability and reaction selectivity.

DETAILED DESCRIPTION OF THE INVENTION

Technical Problem

The present invention provides a new catalyst structure capable of increasing a rate of converting carbon dioxide ($CO_2$) to a $C_2$ or higher hydrocarbon compound.

However, the scope of the present invention is not limited thereto.

Technical Solution

According to an aspect of the present invention, there is provided a catalyst structure for electrochemical carbon dioxide ($CO_2$) reduction.

The catalyst structure includes carbon nanofibers doped with nitrogen (N), and copper (Cu) particles dispersed on the carbon nanofibers.

At least portions of the carbon nanofibers at interfaces with the Cu particles may have a pyridinic-N structure.

The pyridinic-N structure may have a content higher than a content of a pyrrolic-N or graphitic-N structure in the carbon nanofibers.

The carbon nanofibers may have a diameter ranging from 100 nm to 200 nm.

The Cu particles may have a diameter ranging from 10 nm to 40 nm.

The pyridinic-N structure may have a content higher than or equal to 50 at % with respect to all N-doped structures.

According to another aspect of the present invention, there is provided a method of producing a catalyst structure for electrochemical carbon dioxide ($CO_2$) reduction.

The method includes producing a carbon nanofiber precursor by electrospinning a spinning solution including the carbon nanofiber precursor containing a copper (Cu) precursor and nitrogen (N), and producing a carbon nanofiber composite including carbon nanofibers and Cu particles dispersed on the carbon nanofibers, by performing calcination on the carbon nanofiber precursor in a gas atmosphere including oxygen The performing of the calcination may include locally transiting, to a pyridinic-N structure, at least portions of the carbon nanofibers at interfaces with the Cu particles.

The calcination may be performed at a temperature ranging from 800° C. to 900° C., and a partial pressure of oxygen in the gas atmosphere ranging from 50 mTorr to 1 Torr.

The Cu precursor may include copper acetate, copper nitrate, or copper chloride.

The carbon nanofiber precursor including N may include polyvinylpyrrolidone (PVP), polyaniline (PANI), polypyrrole (PPy), cyanamide, or polybenzimidazole (PBI).

Advantageous Effects

Based on the above-described catalyst for carbon dioxide ($CO_2$) reduction, according to an embodiment of the present invention, due to a structure including, as a first catalyst, a pyridinic-N carbon structure for reducing $CO_2$ to carbon monoxide (CO), and including, as a second catalyst, Cu particles positioned in the vicinity of the pyridinic-N carbon structure to form a $C_2$ or higher hydrocarbon compound through dimerization from CO, a series of reactions for decomposing CO from $CO_2$ and converting CO to a $C_2$ or higher hydrocarbon compound may consecutively occur and thus high $CO_2$ conversion efficiency may be achieved.

However, the above-described effects are merely examples and the scope of the present invention is not limited thereto.

BEST MODE

Figure 1:
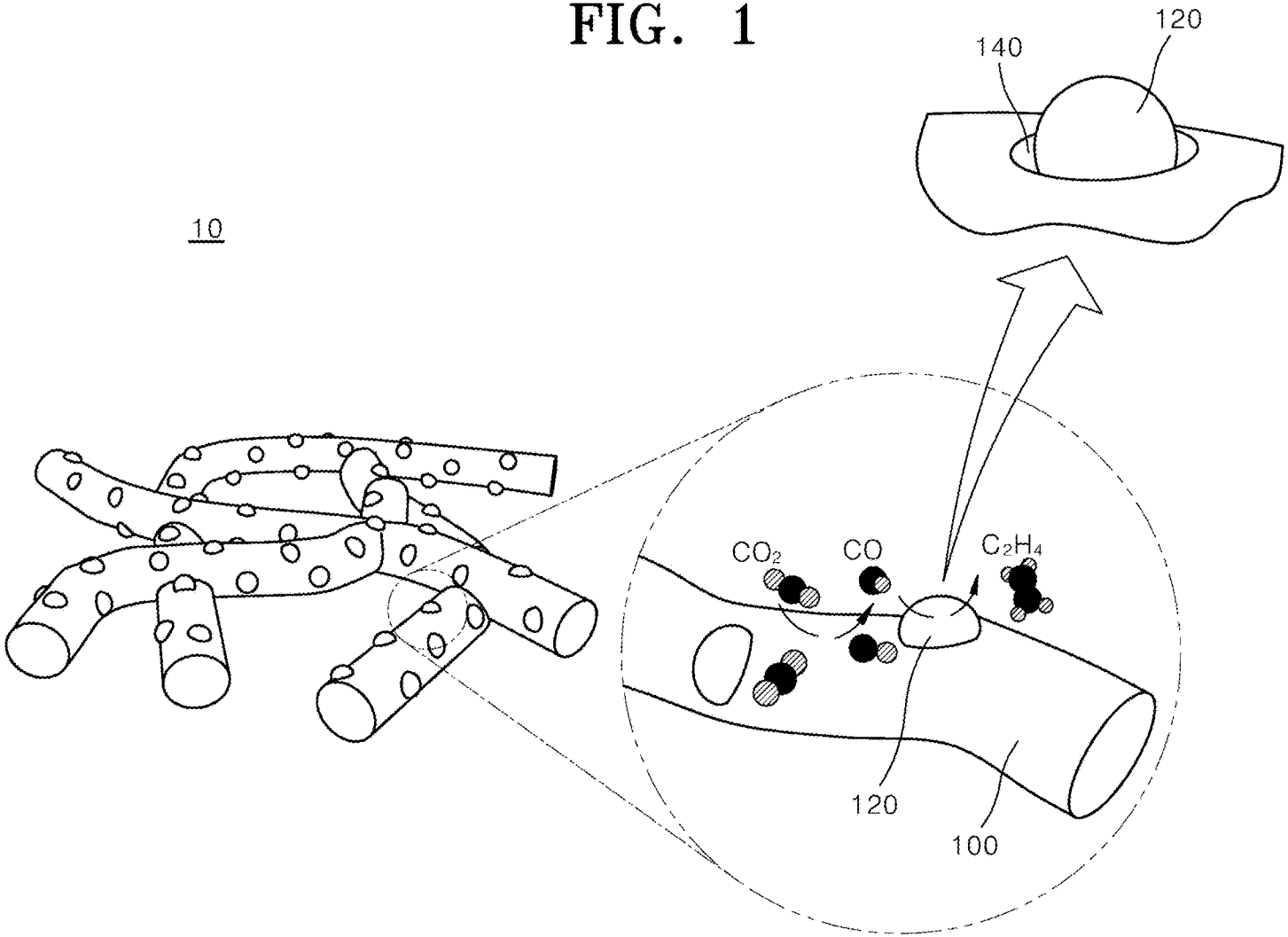
FIG. 1 shows the structure of a carbon nanofiber composite according to an embodiment of the present invention.

The following detailed description of the invention will be made with reference to the accompanying drawings illustrating specific embodiments of the invention by way of example. These embodiments will be described in sufficient detail such that the invention may be carried out by one of ordinary skill in the art. It should be understood that various embodiments of the invention are different, but are not necessarily mutually exclusive. For example, a specific shape, structure, or characteristic described in relation to an embodiment may be implemented as another embodiment without departing from the scope of the invention. In addition, it should be understood that positions or arrangements of individual elements in each disclosed embodiment may be changed without departing from the scope of the invention. Therefore, the following detailed description should not be construed as being restrictive and, if appropriately described, the scope of the invention is defined only by the appended claims and equivalents thereof. In the drawings, like reference numerals denote like functions, and the dimensions of elements may be exaggerated for convenience of explanation.

Hereinafter, the present invention will be described in detail by explaining embodiments of the invention with reference to the attached drawings, such that one of ordinary skill in the art may easily carry out the invention.

FIG. 1 shows a carbon nanofiber composite 10 according to an embodiment of the present invention.

Referring to FIG. 1, the carbon nanofiber composite 10 has a structure in which carbon nanofibers 100 are provided as a matrix and copper (Cu) particles 120 are dispersed on the matrix 100. In this case, the carbon nanofibers 100 are doped with nitrogen (N), and locally have a pyridinic-N structure 140 at interfaces with the Cu particles 120.

Figure 12:
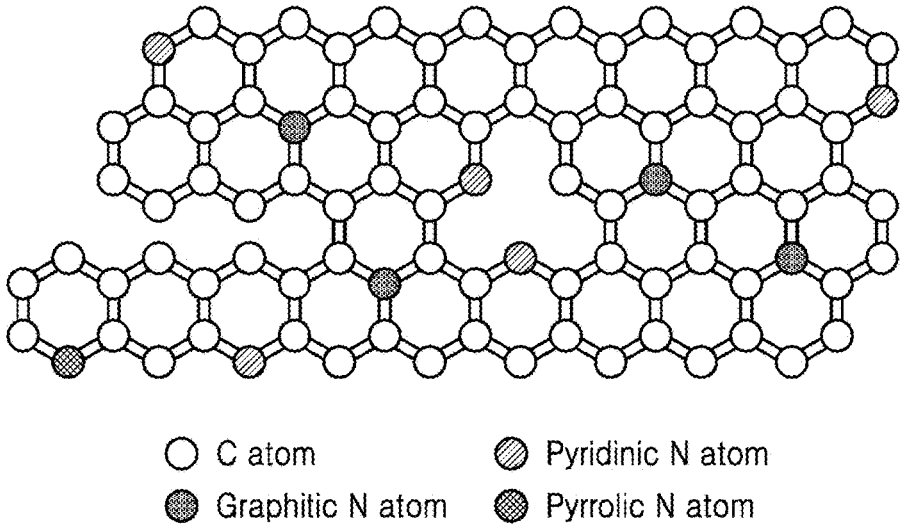
FIG. 12 shows positions of nitrogen (N) atoms corresponding to pyridinic-N, pyrrolic-N, and graphitic-N structures when N is doped on a carbon material.

It is known that, when N is doped on a carbon material, the doped carbon material has pyridinic-N, pyrrolic-N, and graphitic-N structures. FIG. 12 shows positions of N atoms corresponding to the pyridinic-N, pyrrolic-N, and graphitic-N structures when N is doped on a carbon material.

In the N-doped carbon structure, the pyridinic-N structure serves as a catalyst for lowering activation energy of a reaction for reducing carbon dioxide ($CO_2$) to carbon monoxide (CO).

Meanwhile, Cu particles serve as a catalyst for a reaction for reducing $CO_2$ to a $C_2$ or higher hydrocarbon compound. An intermediate such as CO, which is produced from a starting material such as $CO_2$, may be adsorbed on the surface of the Cu particles, and dimerization may occur between the adsorbed CO molecules to form the $C_2$ or higher hydrocarbon compound.

Therefore, as illustrated in FIG. 1, in the carbon nanofiber composite 10, the pyridinic-N structure 140 formed in the vicinity of the Cu particles 120 may serve as a first catalyst for reducing $CO_2$ to CO, and the Cu particles 120 may serve as a second catalyst for converting CO to a $C_2$ or higher hydrocarbon compound, e.g., ethylene ($C_2H_4$).

In a reaction for electrochemically converting $CO_2$ to a hydrocarbon compound at a low temperature less than or equal to 100° C., it is known that it is efficient in terms of energy to reduce a starting material such as $CO_2$ to an intermediate such as CO and then convert CO to the $C_2$ or higher hydrocarbon compound. Therefore, when the carbon nanofiber composite 10 is used as a catalyst for $CO_2$ reduction, consecutive reactions in which the starting material such as $CO_2$ is reduced to CO by the pyridinic-N structure 140 formed on the carbon nanofibers 100, and CO produced as described above is converted to the $C_2$ or higher hydrocarbon compound by the Cu particles 120 positioned nearby may occur.

As illustrated in FIG. 1, the carbon nanofiber composite 10 according to an embodiment of the present invention has a structure in which the pyridinic-N carbon structure 140 serving as the first catalyst for converting $CO_2$ to CO is provided adjacent to the Cu particles 120 serving as the second catalyst for producing the $C_2$ or higher hydrocarbon compound from CO. Therefore, the concentration of CO produced by the pyridinic-N carbon structure 140 serving as the first catalyst is increased in the vicinity of the Cu particles 120 serving as the second catalyst. It means that the amount of CO supplied to the Cu particles 120 serving as the second catalyst is increased. CO produced in the vicinity of the Cu particles 120 is supplied to the Cu particles 120 and then is converted to the $C_2$ or higher hydrocarbon compound, e.g., $C_2H_4$. The series of reactions described above may occur consecutively (see FIG. 1), and thus a production rate of the hydrocarbon compound by the Cu particles 120 may be greatly increased.

In this regard, the carbon nanofiber composite 10 according to an embodiment of the present invention may be considered as a tandem catalyst in which two or more different catalysts form a product through one-pot reaction. The one-pot reaction refers to different chemical reactions consecutively occurring in one catalyst structure, and the tandem catalyst causing the one-pot reaction may increase the efficiency of chemical reaction.

Figure 2:
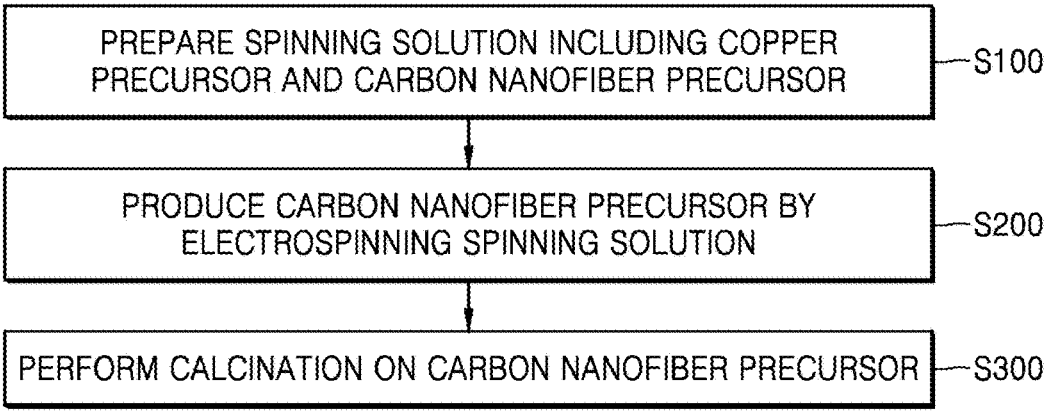
FIG. 2 is a flowchart of a method of producing a carbon nanofiber composite, according to an embodiment of the present invention.

FIG. 2 is a flowchart of a method of producing a carbon nanofiber composite, according to an embodiment of the present invention.

Referring to FIG. 2, the method includes producing a spinning solution for electrospinning, the spinning solution including a Cu precursor and a carbon nanofiber precursor containing N (S100), producing a carbon nanofiber precursor by electrospinning the spinning solution (S200), and performing calcination on the carbon nanofiber precursor in certain temperature and partial pressure of oxygen ranges (S300).

In the producing of the spinning solution (S100), the Cu precursor is a compound in which a functional group is bonded to Cu atoms, and may include, for example, copper acetate, copper nitrate, or copper chloride.

The carbon nanofiber precursor is a material carbonized through calcination, and includes a carbon compound. The carbon nanofiber precursor of the present invention includes a doping element such as N. For example, the carbon nanofiber precursor including N may include polyacrylonitrile (PAN), polyvinylpyrrolidone (PVP), polyaniline (PANI), polypyrrole (PPy), cyanamide, or polybenzimidazole (PBI). N may be doped on ultimately formed carbon nanofibers.

The spinning solution for electrospinning is produced by dissolving and then stirring the Cu precursor and the carbon nanofiber precursor in a solvent, e.g., N,N-dimethylformamide (DMF).

As a modified example, instead of the carbon nanofiber precursor including N, the spinning solution may also be produced by separately adding a carbon nanofiber precursor and an N precursor.

Then, the carbon nanofiber precursor is produced by electrospinning the produced spinning solution (S200). The electrospinning is a method of producing nanofibers based on a solution, and nanofibers may be produced by applying electrostatic repulsion to the spinning solution. The electrospinning technique is already known to one of ordinary skill in the art, and thus a detailed description thereof is not provided herein.

Then, the produced carbon nanofiber precursor is inserted into a heating furnace, an atmosphere of which is controllable, and then the calcination is performed (S300). In this case, the calcination is performed under partial pressure of oxygen and temperature conditions capable of thermodynamically reducing Cu oxide to Cu, by appropriately adjusting the partial pressure of oxygen and the calcination temperature in a gas atmosphere in the heating furnace. To thermodynamically infer the conditions, an Ellingham diagram may be used. Reaction Formulas 1 and 2 show oxidation of Cu, and FIG. 3 is an Ellingham diagram showing the standard Gibbs free energies based on temperatures of Reaction Formulas 1 and 2.

$$2Cu_2O(s)+O_2(g)=4CuO(s) \quad \text{[Reaction Formula 1]}$$

$$4Cu(s)+O_2(g)=2Cu_2O(s) \quad \text{[Reaction Formula 2]}$$

Figure 3:
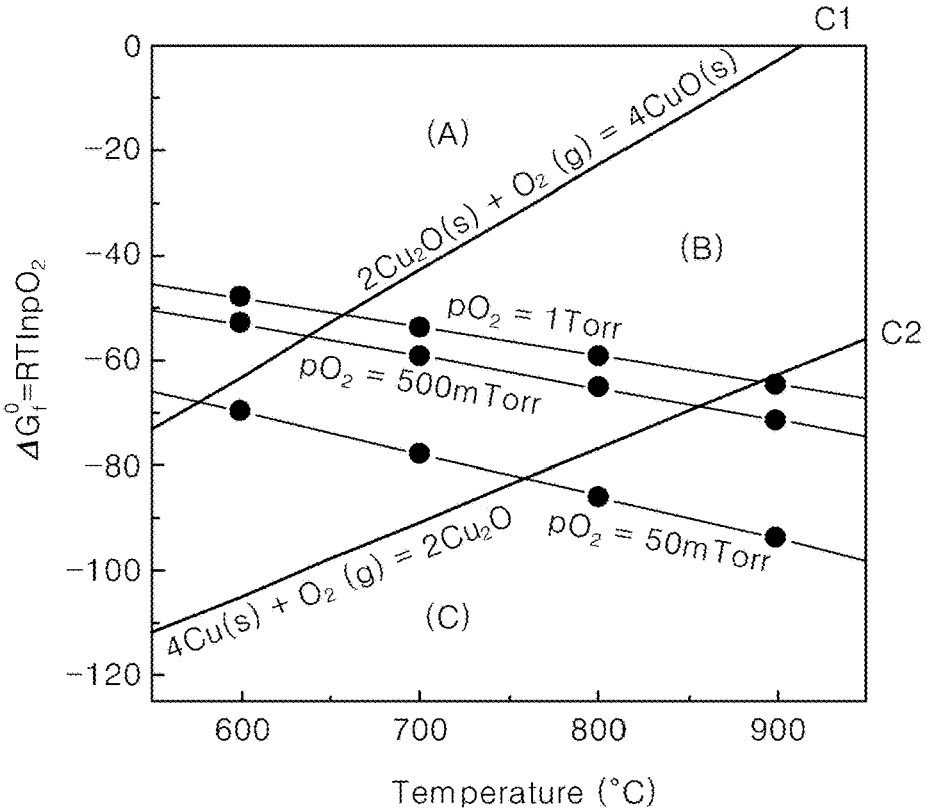
FIG. 3 is an Ellingham diagram showing the standard Gibbs free energies based on temperatures of Reaction Formulas 1 and 2.

Referring to FIG. 3, the temperature and partial pressure of oxygen conditions may be divided into three regions of A, B and C on the basis of a standard Gibbs free energy graph C1 of Reaction Formula 1 and a standard Gibbs free energy graph C2 of Reaction Formula 2.

From a thermodynamic point of view, the region A is a region where reactions of both Reaction Formulas 1 and 2, i.e., oxidation of Cu and $Cu_2O$, may occur. The region B is a region where a reaction of Reaction Formula 1 or a reverse reaction of Reaction Formula 2, i.e., oxidation of Cu or reduction of CuO, may occur. The region C is a region where reverse reactions of Reaction Formulas 1 and 2, i.e., reduction of $Cu_2O$ and CuO, may occur. Referring to the Ellingham diagram of FIG. 3, a region where Cu oxide may be reduced from a thermodynamic point of view is the region B or the region C.

Based on the above-described thermodynamic inference, the calcination may be performed under conditions of maintaining the calcination temperature in a range from 800° C. to 900° C. and maintaining the partial pressure of oxygen in a range from 50 mTorr to 1 Torr. The present inventors have observed that Cu particles are formed in a carbon nanofiber composite produced under the above-described conditions, and a description thereof will be provided below.

Although reduction of Cu oxide is also observed when the calcination is performed at a temperature lower than 800° C., e.g., 700° C., the catalytic activity may be low due to a low electrical conductivity of the carbon nanofiber composite. Meanwhile, the calcination at a temperature higher than 900° C. is considered to be unnecessary in terms of energy.

While the calcination is being performed under the above-described calcination conditions, the Cu precursor is reduced to Cu particles because the functional group is debonded from Cu. In the composite structure in which Cu particles are dispersed on carbon nanofibers as in the current embodiment, the carbon nanofibers at interfaces with the Cu particles locally react with oxygen and burn so as to be transited to a pyridinic-N structure during the calcination. Therefore, when the calcination is completely performed, the carbon nanofiber composite forms a tandem catalyst structure including the Cu particles and the pyridinic-N structure formed in the vicinity of the Cu particles.

Embodiments of the present invention will now be described. However, the following embodiments are merely for better understanding of the present invention, and the present invention is not limited thereto.

A specimen corresponding to Embodiment 1 (Cu/pyNCNF 40 wt %) was produced as described below. Initially, polyacrylonitrile (PAN) and copper acetate (CuAc) were added to and stirred in a N,N-dimethylformamide (DMF) solvent to produce a solution for electrospinning. In this case, a content of copper acetate was 40 wt % with respect to the total solution. After completely stirred, electrospinning was performed to produce a carbon nanofiber precursor. As electrospinning conditions, a voltage was maintained at 18.5 kV, a spinning speed was maintained at 0.5 ml/h, and a distance between a needle and a collector was maintained at 15 cm. About 20 ml of the solution was electrospun on aluminum foil, and then was detached from the foil to perform calcination in a heating furnace. As the calcination, selective oxidation calcination was performed at 800° C. by controlling a partial pressure of oxygen ($pO_2$) in the heating furnace to be 50 mTorr.

A specimen of Embodiment 2 (Cu/pyNCNF 50 wt %) was produced under the same conditions as Embodiment 1 except that the content of copper acetate was 50 wt %. Meanwhile, for Embodiment 2, an experiment of maintaining the partial pressure of oxygen at 500 mTorr and 1 Torr at the same temperature (i.e., 800° C.) was additionally performed to observe reduction of Cu oxide based on the partial pressure of oxygen.

Meanwhile, a specimen of Comparative Example 1 (pyNCNF) was produced by selectively etching and removing only Cu particles by using nitric acid ($HNO_3$) from the carbon nanofiber composite of Embodiment 1.

A specimen of Comparative Example 2 (NCNF) was produced under the same conditions as Embodiment 1 except that copper acetate was not added.

Meanwhile, for carbon nanofibers not doped with N, a specimen of Comparative Example 3 was produced under the same conditions as Embodiment 2 except that polyvinyl alcohol (PVA) was used instead of polyacrylonitrile (PAN).

Figure 4:
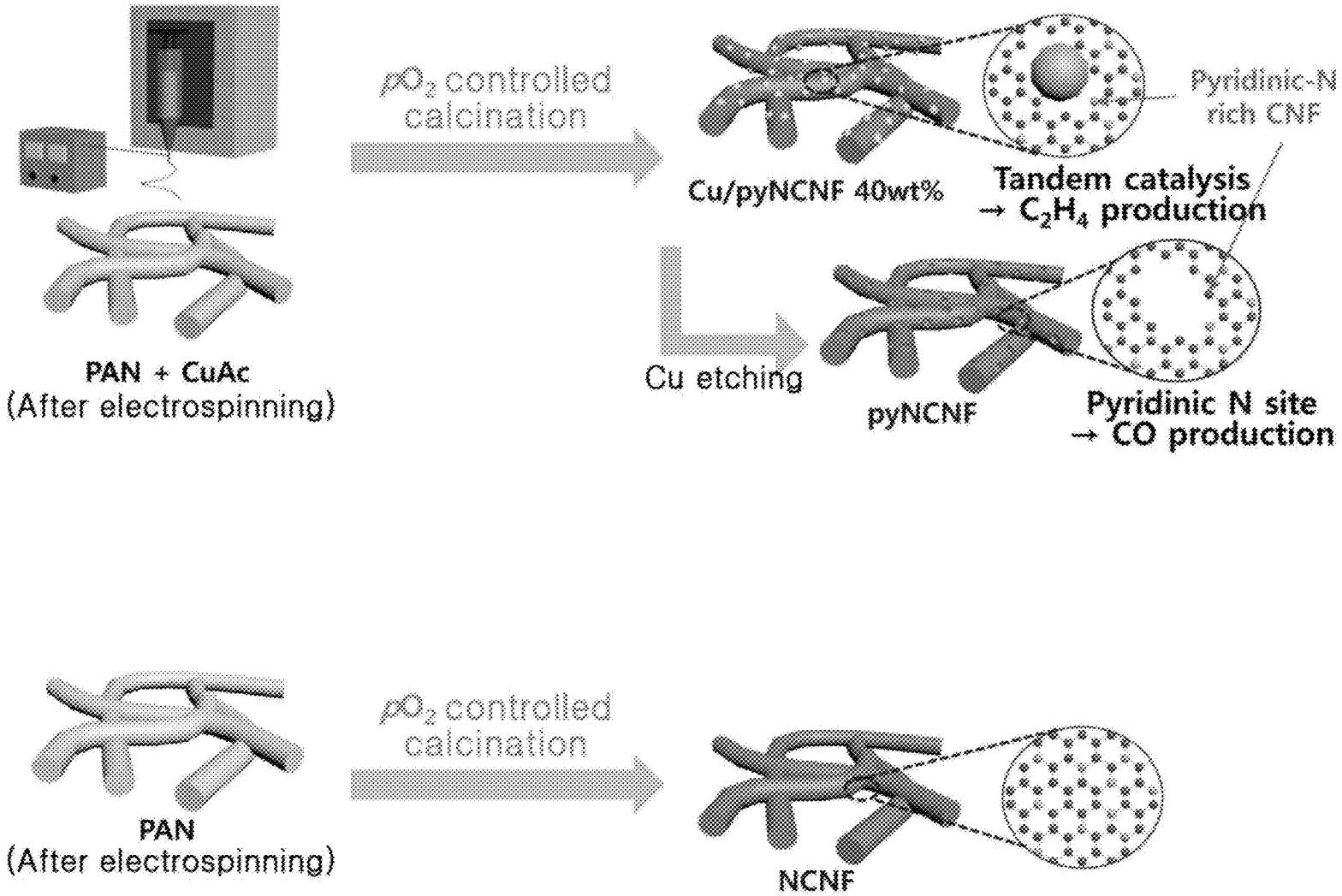
FIG. 4 conceptually shows methods of producing Embodiment 1 (Cu/pyNCNF 40 wt %), Comparative Example 1 (pyNCNF), and Comparative Example 2 (NCNF).

FIG. 4 conceptually shows methods of producing Embodiment 1 (Cu/pyNCNF 40 wt %), Comparative Example 1 (pyNCNF), and Comparative Example 2 (NCNF).

To observe catalytic properties of the carbon nanofiber composites produced as described above, 40 mg of the specimen of each embodiment or comparative example was dispersed in a mixed solution of 9 mL of isopropyl alcohol (IPA) and 20 μL of 5 wt % Nafion to produce ink, and the ink was air-sprayed and then dried on a gas diffusion electrode to produce an electrode for analyzing the properties.

1M and 5M potassium hydroxide (KOH) solutions were inserted as electrolytes into an electrolyzer provided with the produced gas diffusion electrode, and then a $CO_2$ conversion experiment was performed to measure the Faraday efficiency of ethylene ($C_2H_4$), CO, and hydrogen ($H_2$) which are products of $CO_2$ reduction. In this case, speeds of inserting the KOH solutions and $CO_2$ into the electrolyzer were 0.85 ml/min and 20 sccm, respectively, and a voltage applied to the electrode was adjusted in a range of −1.2V to 2.8V.

Figure 5:
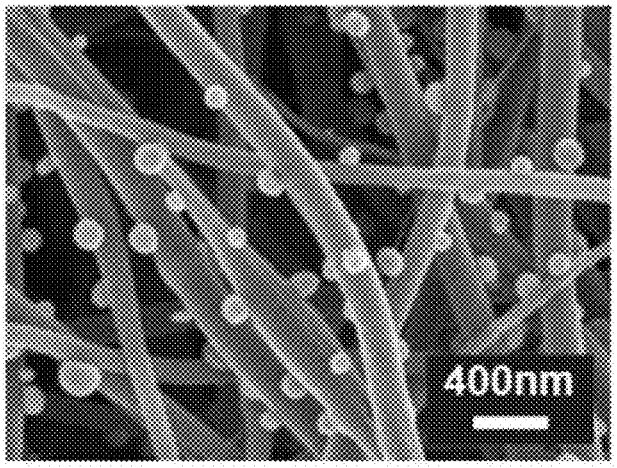
FIG. 5 are scanning electron microscope (SEM) images showing microstructures of Embodiment 1 (Cu/pyNCNF 40 wt %), Comparative Example 1 (pyNCNF), and Comparative Example 2 (NCNF).
Figure 5:
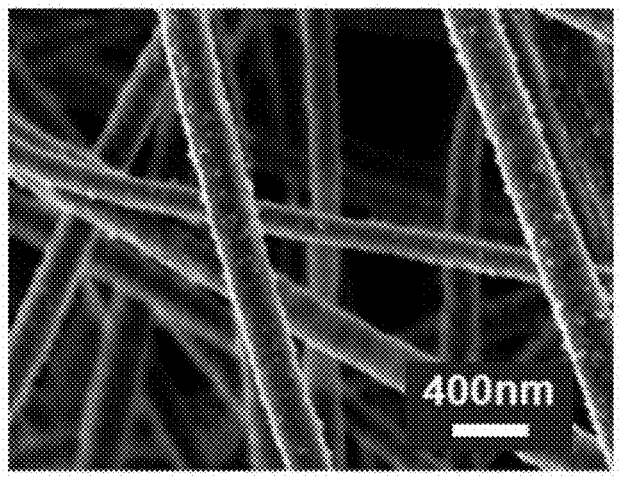
Figure 5:
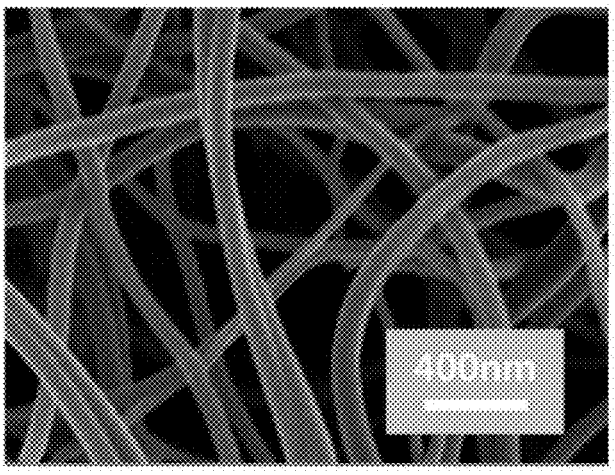

(A) to (c) of FIG. 5 are scanning electron microscope (SEM) images showing microstructures of Embodiment 1 (Cu/pyNCNF 40 wt %), Comparative Example 1 (pyNCNF), and Comparative Example 2 (NCNF).

Referring to (a) of FIG. 5, Embodiment 1 shows that spherical Cu particles having a diameter of about 10 nm to 40 nm are formed on the surface of carbon nanofibers having a diameter ranging from about 100 nm to 200 nm. On the other hand, referring to (b) of FIG. 5, Comparative Example 1 shows that the Cu particles are completely removed from the carbon nanofibers. As in (c) of FIG. 5, Comparative Example 2 shows that only the carbon nanofibers are observed.

Figure 6:
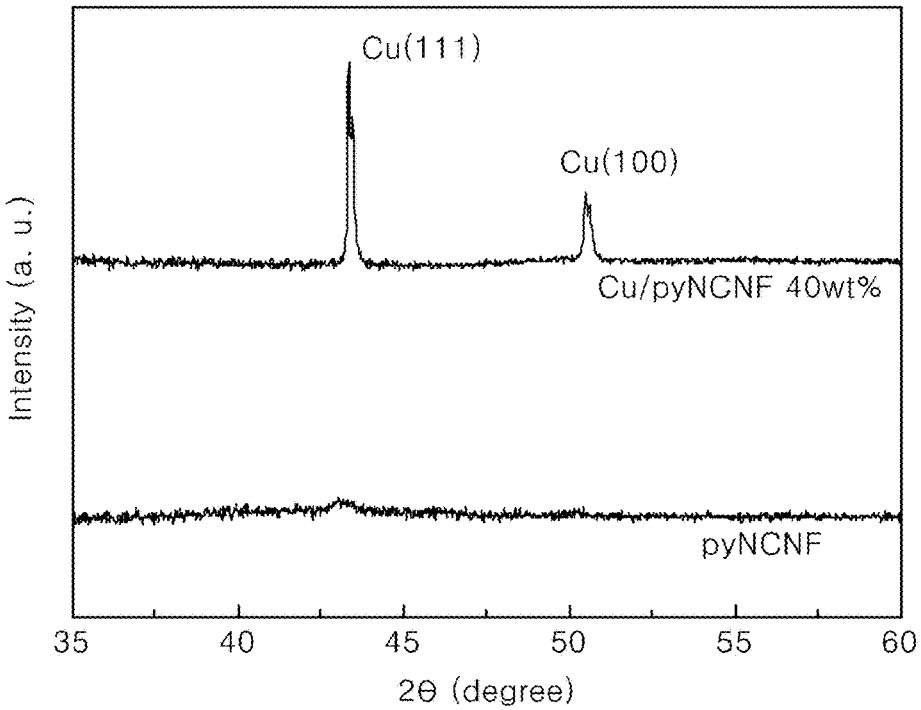
FIG. 6 shows X-ray diffraction (XRD) patterns of Embodiment 1 (Cu/pyNCNF 40 wt %) and Comparative Example 1 (pyNCNF).
Figure 6:
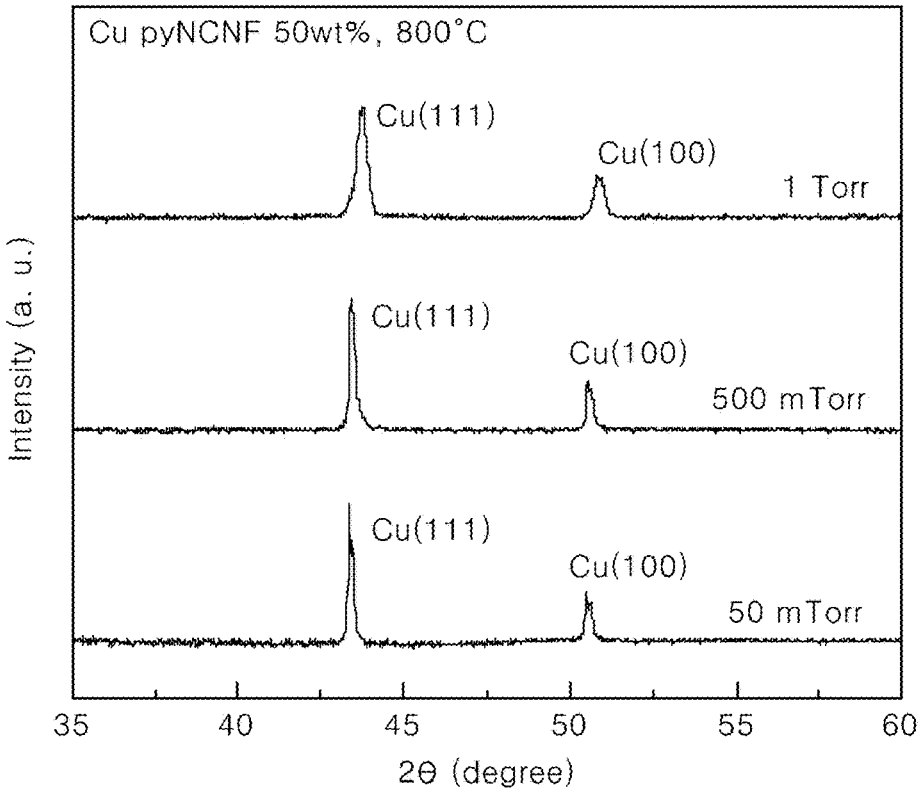

(A) of FIG. 6 shows X-ray diffraction (XRD) patterns of Embodiment 1 (Cu/pyNCNF 40 wt %) and Comparative Example 1 (pyNCNF). Referring to (a) of FIG. 6, (111) and (100) peaks of Cu, which are observed in Embodiment 1, are not observed in Comparative Example 1. It may be resulted that the Cu particles are completely removed from Comparative Example 1.

Referring to (b) of FIG. 6, at 800° C., Cu peaks are observed at the partial pressure of oxygen ranging from 50 mTorr to 1 Torr, and it may be resulted that Cu oxide is completely reduced to Cu.

Table 1 shows contents (at %) of N-doped structures, which are measured by analyzing X-ray photoelectron spectroscopy (XPS) N1s spectrums of the embodiments and the comparative examples. Herein, the contents represent fractions of N-doped carbon structures such as pyridinic-N, pyrrolic-N and graphitic-N structures in atomic percentage (at %) assuming that a sum of the structures is 100. Table 2 shows maximum selectivities of $C_2H_4$ and CO produced when $CO_2$ is reduced using the embodiments and the comparative examples. In this case, 1M and 5M KOH solutions were used as electrolytes.

TABLE 1

| | Name | Pyridinic-N structure (at %) | Pyrrolic-N structure (at %) | Graphitic-N structure (at %) |
|---|---|---|---|---|
| Embodiment 1 | Cu/pyNCNF 40 wt % | 55.26 | 32.08 | 12.15 |
| Embodiment 2 | Cu/pyNCNF 50 wt % | 59.75 | 34.36 | 5.89 |
| Comparative Example 2 | NCNF | 43.38 | 50.54 | 6.08 |
| Comparative Example 3 | Cu/CNF | — | — | — |

TABLE 2

| | Name | Maximum $C_2H_4$ selectivity (%) | Maximum CO selectivity (%) |
|---|---|---|---|
| Embodiment 1 | Cu/pyNCNF 40 wt % | 1M KOH: 27% at −0.97 $V_{RHE}$ | i) 1M KOH: 59% at −0.66 $V_{RHE}$ |
| Embodiment 2 | Cu/pyNCNF 50 wt % | i) 1M KOH: 49% at −0.9 $V_{RHE}$ ii) 5M KOH: 63% at −0.57 $V_{RHE}$ | i) 1M KOH: 65% at −0.6 $V_{RHE}$ ii) 5M KOH: 45% at −0.43 $V_{RHE}$ |
| Comparative Example 2 | NCNF | — | 1M KOH: 3% at −0.55 $V_{RHE}$ |
| Comparative Example 3 | Cu/CNF | 5M KOH: 37% at −0.76 $V_{RHE}$ | 5M KOH: 22% at −0.78 $V_{RHE}$ |

Referring to Table 1, in Embodiments 1 and 2, the content of the pyridinic-N structure is highest to exceed 50 at %, and is followed by the content of the pyrrolic-N structure and the content of the graphitic-N structure. On the other hand, in Comparative Example 2 not including Cu, the content of the pyrrolic-N structure is highest to exceed 50 at %. Meanwhile, in Comparative Example 3 not doped with N, as expected, no N peak is detected.

It may be resulted that Embodiments 1 and 2 exhibit a higher content of the pyridinic-N structure in the carbon nanofibers compared to Comparative Example 2, and include the pyridinic-N structure more than the pyrrolic-N structure. It may be regarded that the above result is because, as described above, the carbon structure in the vicinity of the Cu particles burns during calcination in the Cu reduction atmosphere and is transited to the pyridinic-N structure.

Referring to Table 2, Embodiments 1 and 2 exhibit higher maximum $C_2H_4$ and CO selectivities compared to Comparative Examples 2 and 3, and it may be determined that this result is attributed to the difference in content of the pyridinic-N structure in the carbon nanofibers.

Figure 7:
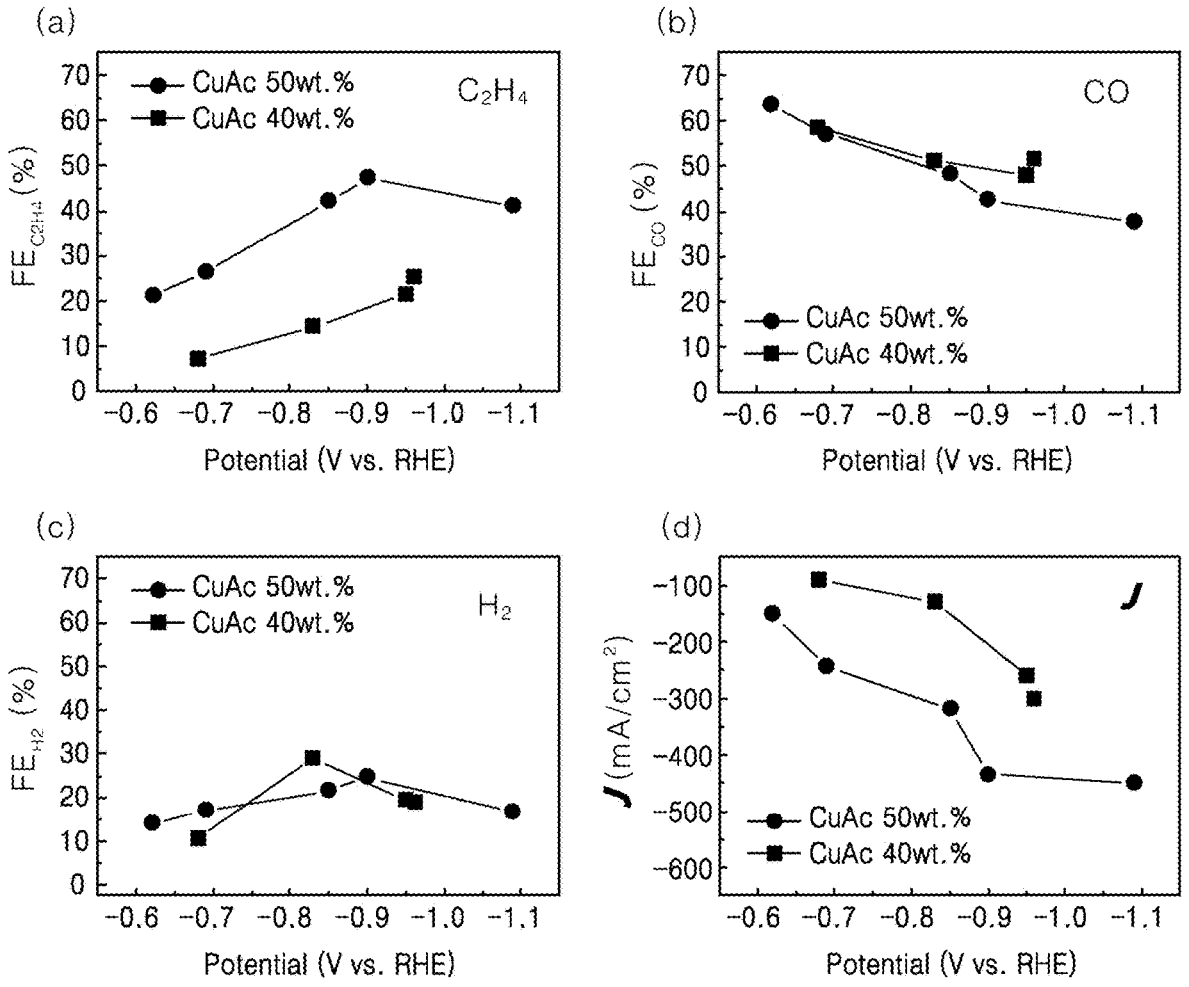
FIG. 7 shows Faraday efficiencies based on produced materials, and current densities of Embodiments 1 and 2 when 1M potassium hydroxide (KOH) is used as an electrolyte.

FIG. 7 shows Faraday efficiencies based on produced materials, and current densities of Embodiments 1 and 2 when 1M KOH is used as an electrolyte.

Referring to (a) of FIG. 7, $C_2H_4$ exhibits a higher Faraday efficiency in Embodiment 2 (CuAc 50 wt %) compared to Embodiment 1 (CuAc 40 wt %) in an applied voltage range. The Faraday efficiency refers to a ratio of a current consumed to produce a certain product, to a total current flowing through an electrochemical battery, and thus it means that $C_2H_4$ production efficiency of Embodiment 2 (CuAc 50 wt %) is higher than that of Embodiment 1 (CuAc 40 wt %). It is regarded that this result is attributed to the difference in content of inserted copper acetate, and is because the content of the Cu particles corresponding to catalytically active sites for $CO_2$ conversion on the carbon nanofiber composite is higher in Embodiment 2 (CuAc 50 wt %) than in Embodiment 1 (CuAc 40 wt %). This result is consistent with the result of (d) of FIG. 7 showing the current densities.

Meanwhile, referring to (b) of FIG. 7, because CO produced by the pyridinic-N structure in Embodiment 2 (CuAc 50 wt %) having a higher content of the Cu particles is consumed a lot to be converted to $C_2H_4$, a concentration of CO in Embodiment 2 (CuAc 50 wt %) exhibits a lower Faraday efficiency compared to Embodiment 1 (CuAc 40 wt %). Referring to (c) of FIG. 7, $H_2$ exhibits a value lower than or equal to a certain value in both embodiments.

Figure 8:
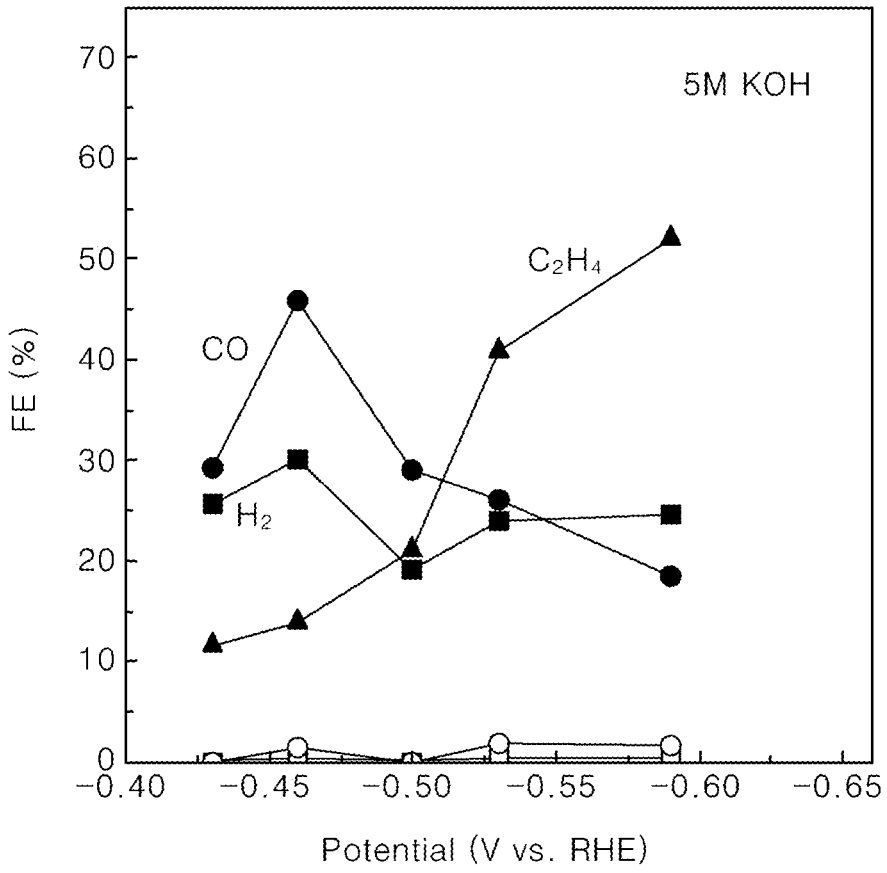
FIG. 8 shows Faraday efficiencies of produced materials based on applied voltages of Embodiment 2 (Cu/pyNCNF 50 wt %) when 5M KOH is used as an electrolyte.

FIG. 8 shows Faraday efficiencies of produced materials based on applied voltages of Embodiment 2 when 5M KOH is used as an electrolyte.

Referring to FIG. 8, when a negative voltage greater than −0.5V is applied, a production rate of $C_2H_4$ is higher than that of CO or $H_2$. That is, in Embodiment 2, a selectivity of $C_2H_4$ production may be increased by applying a negative voltage greater than −0.5V.

Figure 9:
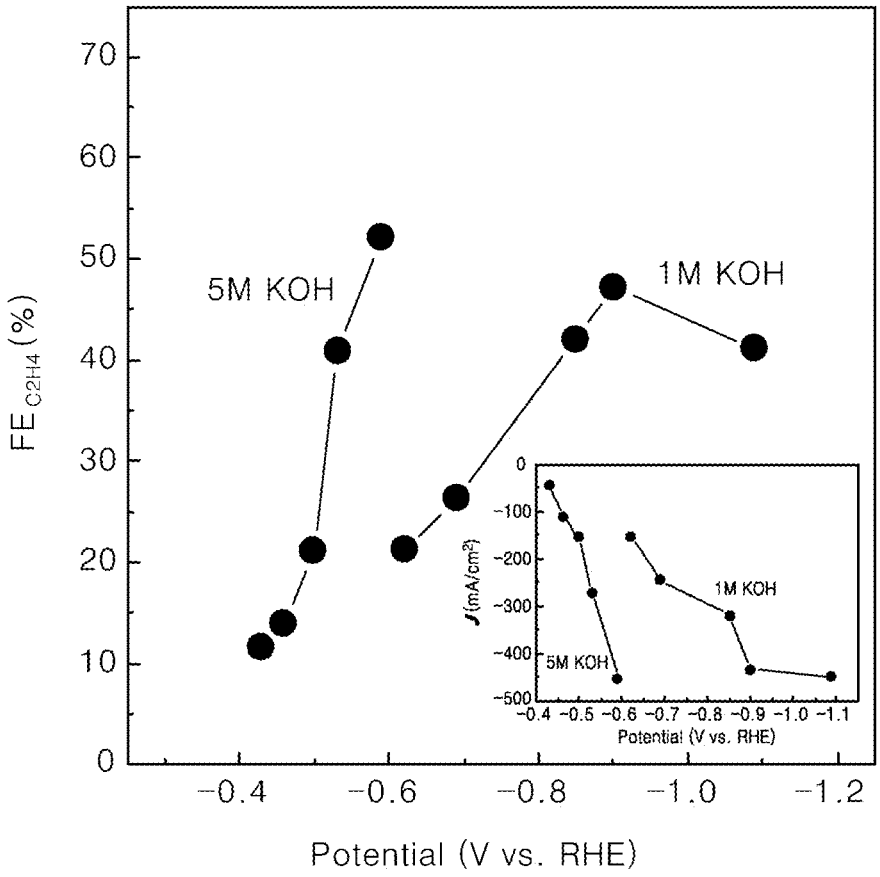
FIG. 9 shows a selectivity of ethylene ($C_2H_4$) production of Embodiment 2 (Cu/pyNCNF 50 wt %) based on an electrolyte.

FIG. 9 shows a selectivity of $C_2H_4$ production of Embodiment 2 based on an electrolyte. A bottom right portion in the graph of FIG. 9 shows a current density under the same conditions.

Referring to FIG. 9, when a concentration of the electrolyte is 5M, a higher Faraday efficiency is exhibited compared to 1M at the same applied voltage. It is regarded that this result is because $H_2$ production reaction is suppressed and thus $CO_2$ reduction efficiency is increased when the pH value is high, that is, when the concentration of KOH is high.

Figure 10:
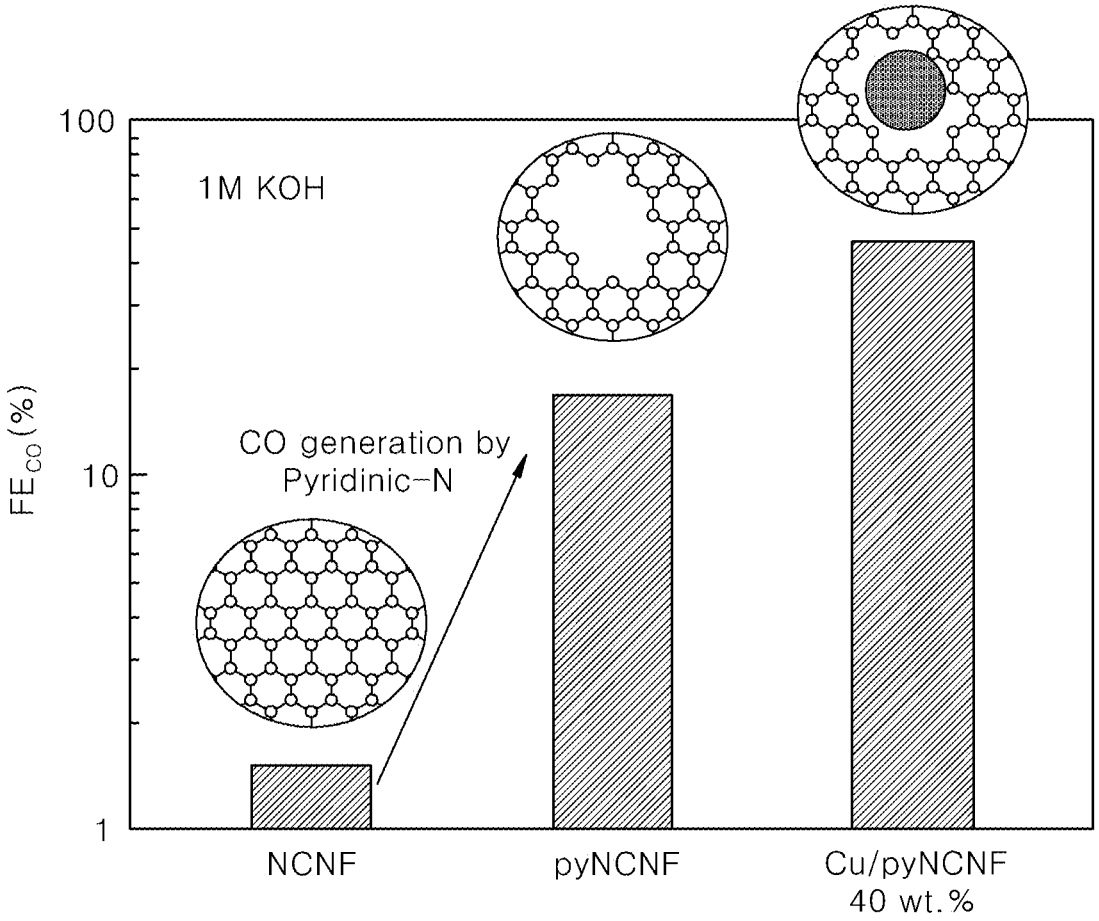
FIG. 10 shows Faraday efficiencies of carbon monoxide (CO) production of Comparative Example 2 (NCNF), Comparative Example 1 (pyNCNF), and Embodiment 1 (Cu/pyNCNF 40 wt %).

FIG. 10 shows Faraday efficiencies of CO production of Comparative Example 2 (NCNF), Comparative Example 1 (pyNCNF), and Embodiment 1 (Cu/pyNCNF 40 wt %).

Referring to FIG. 10, Comparative Example 2 (NCNF) having a relatively low content of the pyridinic-N structure exhibits a very low Faraday efficiency, but Embodiment 1 (Cu/pyNCNF 40 wt %) having a relatively high content of the pyridinic-N structure exhibits a remarkably increased Faraday efficiency.

Comparative Example 1 (pyNCNF), in which the Cu particles are selectively removed from Embodiment 1, still exhibits a high CO production rate compared to Comparative Example 2. According to this result, it may be inferred that, although the Cu particles are removed, because the pyridinic-N structure formed in the vicinity of the Cu particles remains, a high production rate of CO may be maintained.

Figure 11:
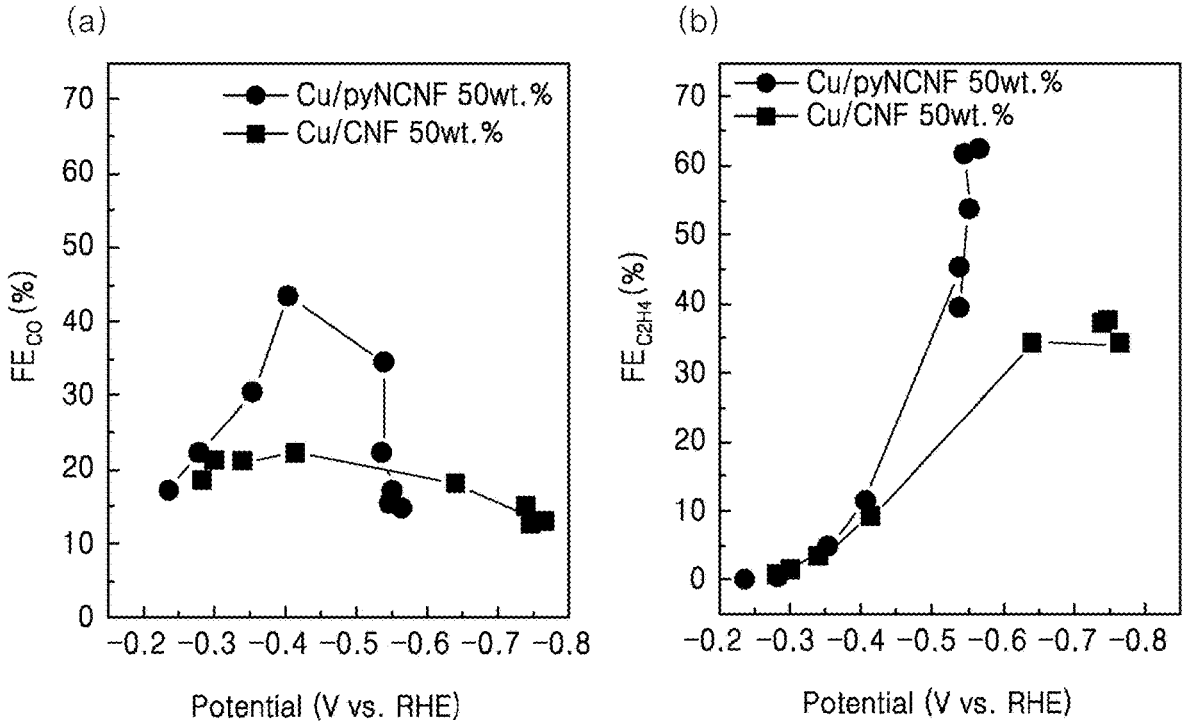
FIG. 11 shows CO and $C_2H_4$ selectivities of Embodiment 2 (Cu/pyNCNF 50 wt %) and Comparative Example 3 (Cu/CNF 50 wt %) based on whether N is doped.

FIG. 11 shows CO and $C_2H_4$ selectivities of Embodiment 2 (Cu/pyNCNF 50 wt %) and Comparative Example 3 (Cu/CNF 50 wt %) based on whether N is doped.

In Embodiment 2 (Cu/pyNCNF 50 wt %), an increase in CO production is shown in a period of −0.4V to −0.5V, and a rapid increase in $C_2H_4$ selectivity is shown after the above-mentioned period. On the other hand, in Comparative Example 3 (Cu/CNF 50 wt %), no increase in CO is shown in the period of −0.4V to −0.5V, and only 37% of the maximum value of $C_2H_4$ selectivity is shown. The maximum value is obtained by applying a higher potential but is still lower than that of Embodiment 2.

Comparative Example 3 includes the carbon nanofibers not doped with N, and thus does not exhibit the effect of the pyridinic-N structure of Embodiment 2.

While the present invention has been particularly shown and described with reference to embodiments thereof, it will be understood by one of ordinary skill in the art that various changes in form and details may be made therein without departing from the scope of the present invention as defined by the following claims.

INDUSTRIAL APPLICABILITY

The present invention provides a new catalyst structure capable of converting carbon dioxide ($CO_2$) to a $C_2$ or higher hydrocarbon compound at a high conversion rate. Therefore, the present invention may be used to remove and recycle greenhouse gases such as $CO_2$, to reduce $CO_2$ based on an electrochemical catalyst, to produce various types of high value-added chemical materials such as formate, methane, ethylene, and alcohol, and for a variety of catalyst systems.

The invention claimed is:

1. A catalyst structure for electrochemical carbon dioxide ($CO_2$) reduction, the catalyst structure comprising:

carbon nanofibers provided as a matrix and doped with nitrogen (N); and copper (Cu) particles dispersed on the carbon nanofibers, wherein at least portions of the carbon nanofibers at interfaces with the Cu particles have a pyridinic-N structure, wherein the pyridinic-N structure is a first catalyst for reducing carbon dioxide ($CO_2$) to carbon monoxide (CO), wherein the Cu particles are a second catalyst for converting CO to a $C_2$ or higher hydrocarbon compound through dimerization between a plurality of CO molecules, and wherein the pyridinic-N structure is formed directly adjacent to and surrounds the Cu particles at a location where the carbon nanofibers directly contact the Cu particles.

2. The catalyst structure of claim 1, wherein a content of the pyridinic-N structure is higher than a content of a pyrrolic-N or graphitic-N structure in the carbon nanofibers.

3. The catalyst structure of claim 1, wherein the carbon nanofibers have a diameter ranging from 100 nm to 200 nm.

4. The catalyst structure of claim 1, wherein the Cu particles have a diameter ranging from 10 nm to 40 nm.

5. The catalyst structure of claim 1, wherein the pyridinic-N structure has a content higher than or equal to 50 at % with respect to all N-doped structures.

6. The catalyst structure of claim 1, wherein CO is adsorbed on a surface of the Cu particles, and the dimerization occurs between the plurality of CO molecules adsorbed on the surface of the Cu particles to form the $C_2$ or higher hydrocarbon compound.

7. The catalyst structure of claim 1, wherein a carbon nanofiber composite comprising the carbon nanofibers doped with N and the Cu particles dispersed thereon is a tandem catalyst causing one-pot reaction, wherein in the one-pot reaction, different chemical reactions consecutively occur in one catalyst structure.

8. The catalyst structure of claim 1, wherein the catalyst structure is formed at a temperature ranging from 800° C. to 900° C. and a partial pressure of oxygen in a gas atmosphere ranging from 50 mTorr to 1 Torr.

9. The catalyst structure of claim 1, wherein the carbon nanofiber doped with N is selected from a group consisting of: polyvinylpyrrolidone (PVP), polyaniline (PANI), polypyrrole (PPy), cyanamide, and polybenzimidazole (PBI).

10. A method of producing a catalyst structure for electrochemical carbon dioxide ($CO_2$) reduction, the method comprising:

producing a carbon nanofiber precursor by electrospinning a spinning solution comprising the carbon nanofiber precursor containing a copper (Cu) precursor and nitrogen (N); and producing a carbon nanofiber composite comprising carbon nanofibers and Cu particles dispersed on the carbon nanofibers by performing calcination on the carbon nanofiber precursor in a gas atmosphere comprising oxygen, wherein the performing of the calcination comprises locally transiting, to a pyridinic-N structure, at least portions of the carbon nanofibers at interfaces with the Cu particles, and wherein the pyridinic-N structure is formed directly adjacent to and surrounds the Cu particles at a location where the carbon nanofibers directly contact the Cu particles.

11. The method of claim 10, wherein the calcination is performed at a temperature ranging from 800° C. to 900° C.

and a partial pressure of oxygen in the gas atmosphere ranging from 50 mTorr to 1 Torr.

12. The method of claim 10, wherein the Cu precursor comprises copper acetate, copper nitrate, or copper chloride.

13. The method of claim 10, wherein the carbon nanofiber precursor comprising N comprises polyvinylpyrrolidone (PVP), polyaniline (PANI), polypyrrole (PPy), cyanamide, or polybenzimidazole (PBI).

* * * * *